US008068073B2

(12) United States Patent
Kim

(10) Patent No.: US 8,068,073 B2
(45) **Date of Patent: *Nov. 29, 2011**

(54) CIRCUIT AND METHOD FOR DRIVING PIXEL OF ORGANIC ELECTROLUMINESCENT DISPLAY

(75) Inventor: Keum-nam Kim, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 860 days.

This patent is subject to a terminal disclaimer.

(21) Appl. No.: 12/024,869

(22) Filed: Feb. 1, 2008

(65) Prior Publication Data

US 2008/0136753 A1 Jun. 12, 2008

Related U.S. Application Data

(63) Continuation of application No. 10/898,447, filed on Jul. 24, 2004, now Pat. No. 7,358,938.

(30) Foreign Application Priority Data

Sep. 8, 2003 (KR) ..... 10-2003-0062851

(51) Int. Cl.
*G09G 3/30* (2006.01)

(52) U.S. Cl. ..... 345/77; 345/76
(58) Field of Classification Search ..... 345/76, 345/77
See application file for complete search history.

(56) References Cited

U.S. PATENT DOCUMENTS

| | | | | |
|---|---|---|---|---|
| 6,348,906 | B1 | 2/2002 | Dawson et al. | |
| 7,109,952 | B2 | 9/2006 | Kwon | |
| 7,154,454 | B2 | 12/2006 | Okabe et al. | |
| 2003/0011584 | A1 * | 1/2003 | Azami et al. | 345/204 |
| 2003/0112208 | A1 | 6/2003 | Okabe et al. | |
| 2006/0082524 | A1 | 4/2006 | Kwon | |

OTHER PUBLICATIONS

Chinese Office action dated Jan. 5, 2007, for corresponding Chinese application with English translation.

* cited by examiner

*Primary Examiner* — Amare Mengistu
*Assistant Examiner* — Randal Willis
(74) *Attorney, Agent, or Firm* — Christie, Parker & Hale, LLP

(57) ABSTRACT

A circuit and method for driving pixels in an organic electroluminescent display that reduces the number of wirings of a compensation circuit for addressing brightness non-uniformity. The pixel driving circuit includes an organic electroluminescent device that emits light corresponding to an amount of a current being applied. A first transistor is connected to a power supply voltage and applies the current corresponding to a data voltage to the organic electroluminescent device. A first capacitor stores the data voltage, and a threshold voltage compensation unit stores a threshold voltage of the first transistor. A second transistor transmits the data voltage from a data line in response to a selection signal from an nth scan line. A switching unit electrically disconnects a second primary electrode of the first transistor from the organic electroluminescent device while the threshold voltage is stored in the threshold voltage compensation unit in response to a control signal.

13 Claims, 5 Drawing Sheets

CIRCUIT AND METHOD FOR DRIVING PIXEL OF ORGANIC ELECTROLUMINESCENT DISPLAY

CROSS-REFERENCE TO RELATED APPLICATION

This application is a continuation of U.S. patent application Ser. No. 10/898,447 entitled "Circuit and Method for Driving Pixel of Organic Electroluminescent Display," filed on Jul. 24, 2004, now allowed, which claims priority to and the benefit of Korean Patent Application No. 2003-62851, filed on Sep. 8, 2003 in the Korean Intellectual Property Office, the entire content of both of which are incorporated by reference herein.

BACKGROUND OF THE INVENTION

1. Field of the Invention

The present invention relates to an organic electroluminescent (EL) is display and, more particularly, to a circuit and method for driving pixels in an organic electroluminescent display that reduces the number of wirings of a compensation circuit for solving the brightness non-uniformity resulting from a threshold voltage difference of driving transistors arranged in an EL panel, thereby simplifying both the wirings of the EL panel and the driving method.

2. Description of the Related Art

An organic EL device is an emissive device that emits light from a fluorescent material by recombining an electron and a hole, with which an EL display can have a fast response time and a low driving voltage, and can be formed in a ultra-thin film, compared with a passive type light-emitting device, so that it can be applied to a wall mount type or a portable type of displays.

As a method of driving such an organic EL light-emitting cell, there are a passive matrix type and an active matrix type that uses a thin film transistor. The passive matrix type perpendicularly forms an anode and a cathode and selects a line to drive it, while the active matrix type connects a thin film transistor and a capacitor to each ITO pixel electrode to maintain a voltage with the capacitance of the capacitor.

FIG. 1 is a schematic plan view of a conventional active matrix type organic EL display having an EL panel 10, a pixel circuit 11, a scan driver 20, and a data driver 30.

The scan driver 20 sequentially outputs a selection signal through scan lines S1, S2, S3, S4, . . . , $S_Z$, and the data driver 30 outputs a data voltage representing an image signal through data lines D1, D2, D3, . . . , $D_Y$. The pixel circuit 11 is used to display a single pixel.

As shown in FIG. 1, the EL panel 10 includes a plurality of data lines D1, D2, D3, . . . , $D_Y$ branched from the data driver 30 to transmit the image signal, and a plurality of scan lines S1, S2, S3, . . . , Sz arranged such that a plurality of data lines and a plurality of scan lines intersect (i.e., cross over) each other. The scan lines S1, S2, S3, . . . , Sz transmit the selection signal. A pixel circuit 11 is placed at each intersection between the scan lines and the data lines.

FIG. 2 is a detailed circuit diagram illustrating the pixel circuit 11 of FIG. 1. The pixel circuit 11 includes a first thin film transistor M1, a capacitor Cst, a second thin film transistor M2, and an organic EL device OLED (e.g., an organic light emitting diode). In FIG. 2, Vdata indicates a data line in which a pixel signal is transmitted and Select indicates a scan line to which a selection signal is applied.

The data line Vdata transmits an image signal, and the scan line Select transmits a selection signal. The second thin film transistor M2 transmits data to the capacitor Cst according to the selection signal of the scan line Select, and the capacitor Cst stores and holds the applied data. Further, the first thin film transistor M1 drives the organic EL device OLED.

As shown in FIG. 2, the organic EL device OLED is supplied with a current for emitting light, by the first thin film transistor M1 connected to its anode. A cathode of the organic EL device OLED is connect to a voltage Vss (e.g., a ground voltage). Further, for the first thin film transistor M1, a source is connected to a power supply line Vdd, and a gate is connected to a drain of the second thin film transistor M2. The capacitor Cst is connected between the gate of the first thin film transistor M1 and the power supply line Vdd. Further, for the second thin film transistor M2, a gate is connected to the scan line Select, and a source is connected to the data line Vdata.

An operation of the pixel circuit having the above configuration will be described. When the second thin film transistor M2 is turned on by the selection signal Select applied to the gate of the second thin film transistor M2, the data voltage Vdata is applied to the gate of the first thin film transistor M1 through the data line Vdata. Further, corresponding to the data voltage Vdata applied to the gate, a current flows through the first thin film transistor M1 to the organic EL device OLED to emit light.

Here, a voltage Vgs between the source and the gate of the first thin film transistor M1 is a difference between a voltage of the power supply line Vdd and the data voltage transmitted through the second thin film transistor M2, and the first thin film transistor outputs a current corresponding to a square of a difference between the source-gate voltage Vgs and a threshold voltage Vth of the transistor to the organic EL device. This can be represented as the following equation:

$$I_{OLED}=(\beta/2)(Vgs-Vth)^2=(\beta/2)(Vdd-V\text{data}-Vth)^2 \quad \text{(Equation 1)},$$

where $I_{OLED}$ is a current flowing through the organic EL device, Vgs is a voltage between the source and the gate of the transistor M1, Vth is the threshold voltage of the first thin film transistor M1, Vdata is the data voltage, and β is a coefficient value.

As shown in Equation 1, in the pixel circuit illustrated in FIG. 2, a current corresponding to the applied data voltage Vdata is supplied to the organic EL device OLED, and the organic EL device OLED emits light corresponding to the supplied current.

The driving voltage of each power supply line Vdd varies depending on the number of turned-on first thin film transistors M1 that are connected to the power supply line Vdd. This leads to differences between the driving voltages of the connected pixels. Further, even if the voltages are the same, the difference of the threshold voltage Vth in the thin film transistor is generated due to the non-uniformity of the manufacturing process, resulting in a variance to the amount of current supplied to the organic EL device OLED, such that brightness becomes non-uniform.

FIG. 3 shows another pixel circuit, which has been designed to address the above problems associated with the conventional pixel of FIG. 2. By way of example, the pixel circuit of FIG. 3 is capable of preventing brightness non-uniformity due to the change of the threshold voltage Vth of the first thin film transistor M1. FIG. 4 shows a driving timing diagram for driving the circuit of FIG. 3.

As shown in FIG. 3, for a first thin film transistor M3, a source is connected to a driving power supply Vdd and a drain is connected to an organic EL device OLED, and for a fourth thin film transistor M6 connected between the first thin film transistor M3 and the organic EL device OLED, a gate is connected to a light emitting control line AZB. Further, a gate of the first thin film transistor M3 is connected to a first capacitor C1 and a second capacitor C2. In addition, the first capacitor C1 is connected between a source of a third thin film transistor M5 and the power supply line Vdd.

Further, for a second thin film transistor M4, a gate is connected to the scan line Select, a source is connected to the data line Vdata, and a drain is connected to the second capacitor C2. Further, for the third thin film transistor M5, a gate is connected to a threshold voltage compensation control line AZ, a source is connected between the first thin film transistor M3 and the second capacitor C2, and a drain is connected between the drain of the first thin film transistor M3 and the source of the fourth thin film transistor M6.

The conventional pixel driving circuit of FIG. 3 operates according to the timing diagram shown in FIG. 4. It can be described as follows: first, the scan line Select outputs a low signal during a certain time period to turn on the second thin film transistor M4, and the threshold voltage compensation control line AZ applies a low signal during the selected time period of the scan line, thereby turning on the third thin film transistor M5 to proceed with initialization.

Therefore, the first thin film transistor M3 serves as a diode for the driving power supply, and the second capacitor C2 stores a voltage corresponding to the threshold voltage Vth of the first thin film transistor M3.

Further, after the time period for outputting the low signal in the threshold voltage compensation control line AZ, the data voltage is charged to the first capacitor C1 through the second thin film transistor M4 as the data line Vdata applies the low signal.

Further, while the threshold voltage compensation control line AZ applies the low signal, the light emitting control line AZB turns off the fourth thin film transistor M6 by outputting a high signal until the data voltage compensates the difference of the threshold voltage Vth, thereby cutting off the driving current to the organic EL device OLED. Subsequently, when the light emitting control line AZB is changed to a low signal after a certain time period, the fourth thin film transistor M6 is turned on so that the corresponding current emits the organic EL device OLED.

However, in the conventional pixel driving circuit of FIG. 3, an additional threshold voltage compensation control line AZ and light emitting control line AZB are added in addition to the data line and the scan line, so that the wiring of the EL panel becomes more complex, and thus, the number of manufacturing processes increases, leading to an increase in the manufacture cost.

SUMMARY OF THE INVENTION

The present invention provides a circuit and method for driving pixels in an organic electroluminescent display capable of simplifying the number of wirings and wiring processes by implementing a compensation circuit using a previous scan line and a scan line without adding an additional signal line.

In an exemplary embodiment of the present invention, there is provided a pixel driving circuit for an organic electroluminescent display including an organic electroluminescent device that emits light corresponding to an amount of a current being applied. A first transistor is connected to a power supply voltage and applies the current corresponding to a data voltage to the organic electroluminescent device. A first capacitor is connected between a gate electrode of the first transistor and the power supply voltage and stores the data voltage. A threshold voltage compensation unit stores a voltage corresponding to a threshold voltage of the first transistor. A second transistor transmits the data voltage from a data line in response to a selection signal from an nth scan line. A switching unit electrically disconnects a second primary electrode of the first transistor from the organic electroluminescent device while the voltage corresponding to the threshold voltage is being stored in the threshold voltage compensation unit in response to a control signal.

The threshold voltage compensation unit may include: a second capacitor connected to the gate electrode of the first transistor for storing the voltage corresponding to the threshold voltage; a third transistor for applying the power supply voltage to the second capacitor in response to a selection signal from an (n−1)th scan line; and a fourth transistor for configuring the first transistor as a diode in response to the selection signal from the (n−1)th scan line.

The first to fourth transistors may have the same conduction properties, thus making possible compensation of a gate voltage.

Further, the first to fourth transistors may be PMOS type transistors.

Further, the voltage corresponding to the threshold voltage stored in the threshold voltage compensation unit may be provided by the power supply voltage.

The control signal may be the selection signal from the (n−1)th scan line; and the switching unit may include a fifth transistor connected between the first transistor and the organic electroluminescent device. The fifth transistor may respond to the control signal.

The fifth transistor may have a conduction type different from that of the first to fourth transistors.

The fifth transistor may be an NMOS type transistor.

In another exemplary embodiment of the present invention, there is provided a method of driving a pixel of an organic electroluminescent display including a plurality of data lines, a plurality of scan lines crossing the plurality of data lines, and a plurality of pixels that are formed in an array form in an area specified by the plurality of data lines and the plurality of scan lines. The pixel has a transistor that supplies a current to its organic electroluminescent device. The method includes: (a) selecting the previous scan line that applies a selection signal for selecting a row of the pixel, wherein the previous scan line is an (n−1)th scan line; (b) storing a threshold voltage of the transistor in response to the selection signal; (c) after storing the threshold voltage, selecting an nth scan line to turn on a switching transistor and to apply a data voltage; (d) compensating the threshold voltage by storing the applied data voltage; (e) supplying a current corresponding to a sum of the compensated threshold voltage and the applied data voltage to the organic electroluminescent display.

The method of driving the pixel may further include: controlling the organic electroluminescent display such that the current is not supplied while the threshold voltage is applied in response to the selection signal of the previous scan line to prevent a current difference between the pixels.

The power supply voltage may be applied to store the threshold voltage.

In yet another exemplary embodiment of the present invention, a pixel driving circuit for an organic electroluminescent display is provided. An organic electroluminescent device emits light corresponding to an amount of a current being applied. A first capacitor stores a data voltage in response to a first selection signal applied on a first scan line. A first transistor applies the current to the organic electroluminescent device. A second capacitor stores a voltage corresponding to a threshold voltage of the first transistor in response to a second selection signal applied on a second scan line. The stored data voltage and the stored voltage corresponding to the threshold voltage are applied to a gate of the first transistor to generate the current applied to the organic electroluminescent device.

BRIEF DESCRIPTION OF THE DRAWINGS

These and other aspects of the present invention may be better understood by reference to the following detailed description, taken in conjunction with the accompanying drawings, wherein.

DETAILED DESCRIPTION

Figure 1:
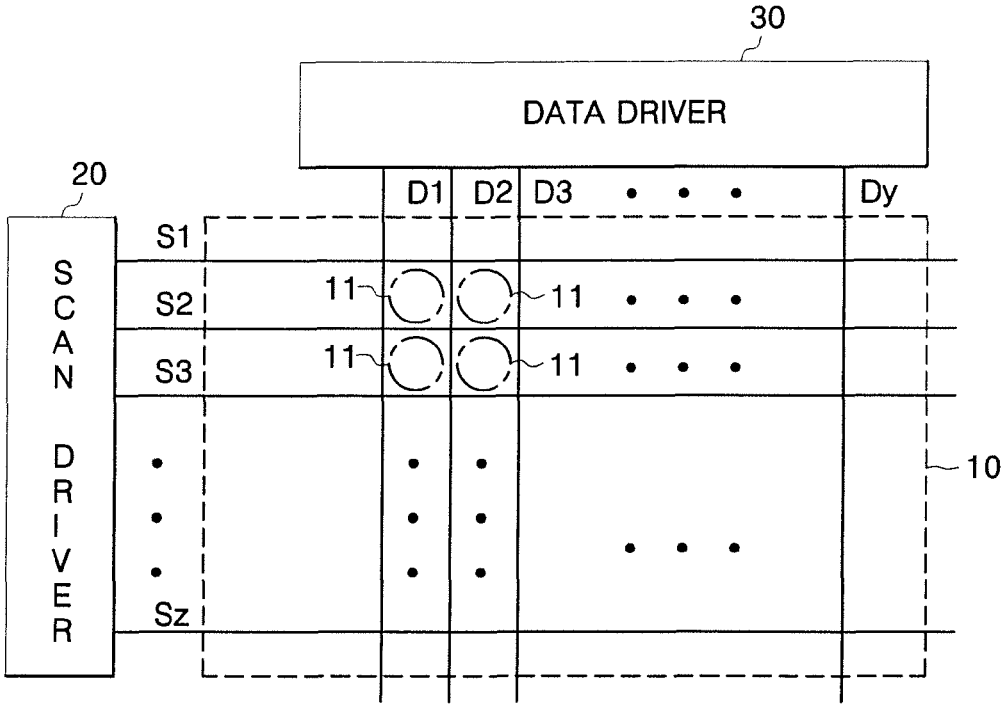
FIG. 1 (PRIOR ART)
FIG. 1 is a schematic plan view of a conventional organic EL display.
Figure 2:
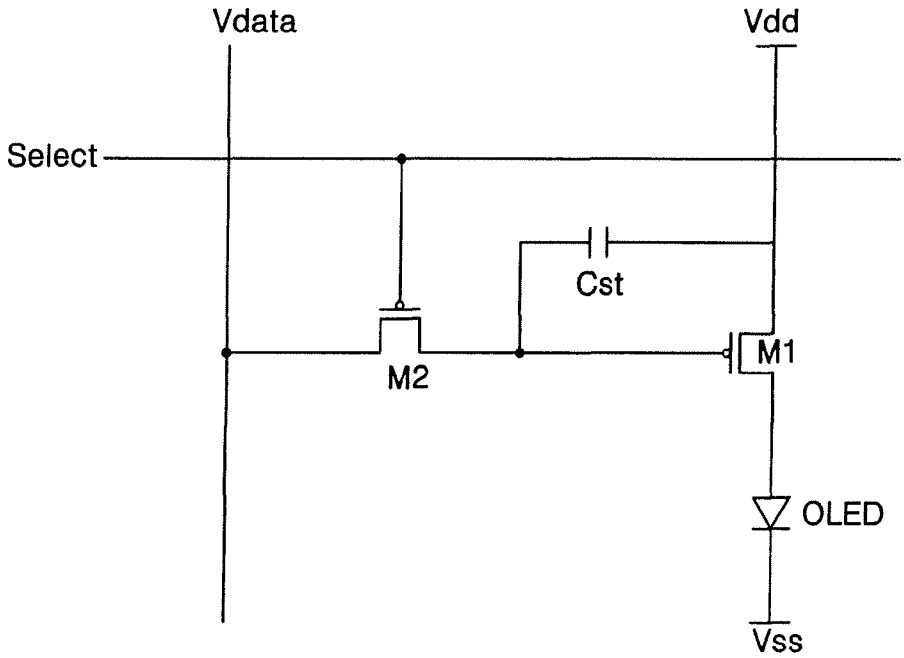
FIG. 2 (PRIOR ART)
FIG. 2 is a conventional pixel circuit for driving an organic electroluminescent device of FIG. 1.
Figure 3:
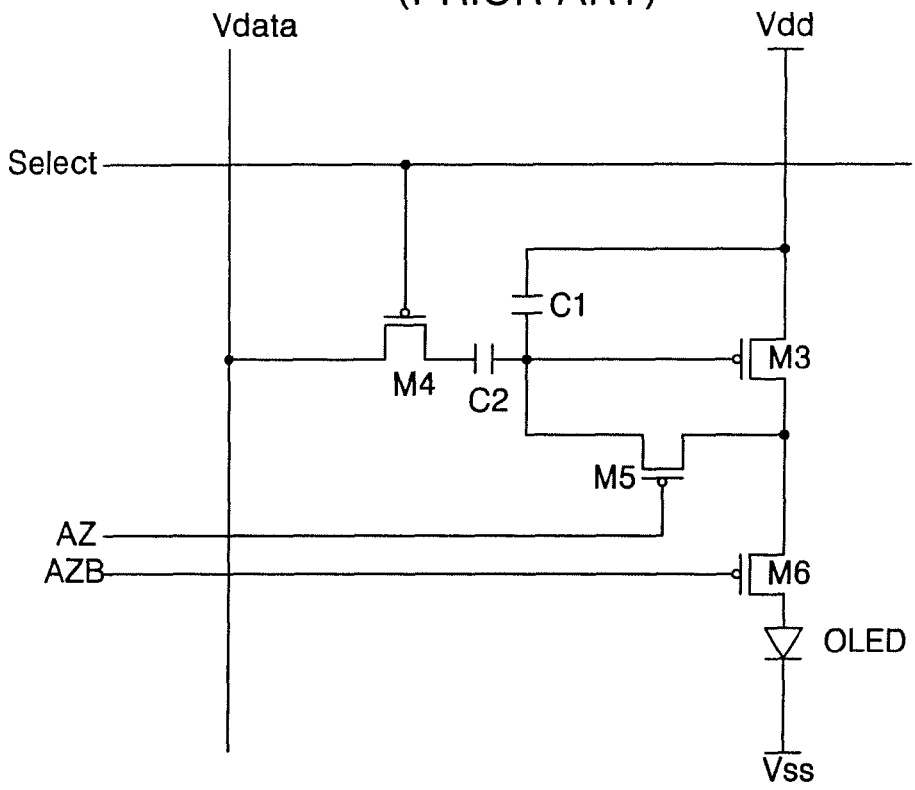
FIG. 3 (PRIOR ART)
FIG. 3 is a pixel circuit having a compensation circuit for a threshold voltage Vth of a first thin film transistor.
Figure 4:
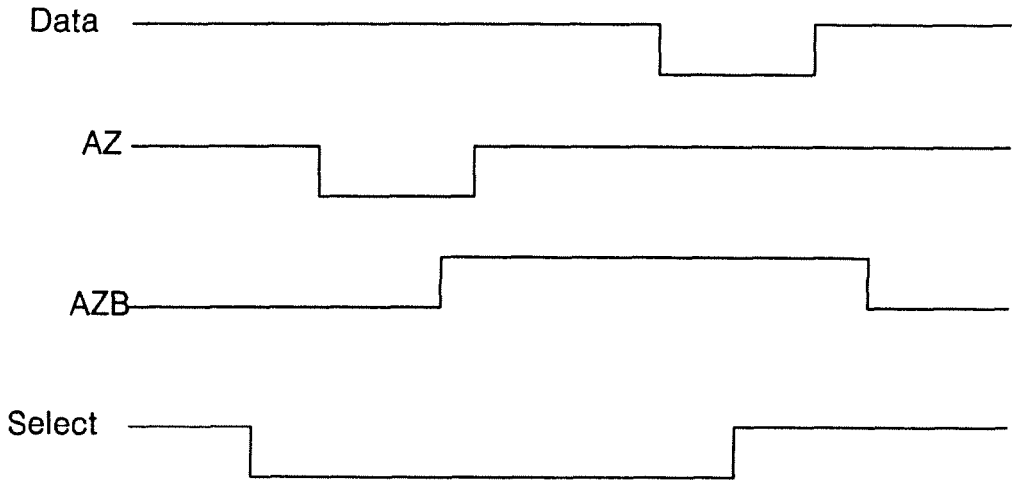
FIG. 4 (PRIOR ART)
FIG. 4 is a driving timing diagram for driving the pixel circuit of FIG. 3.
Figure 5:
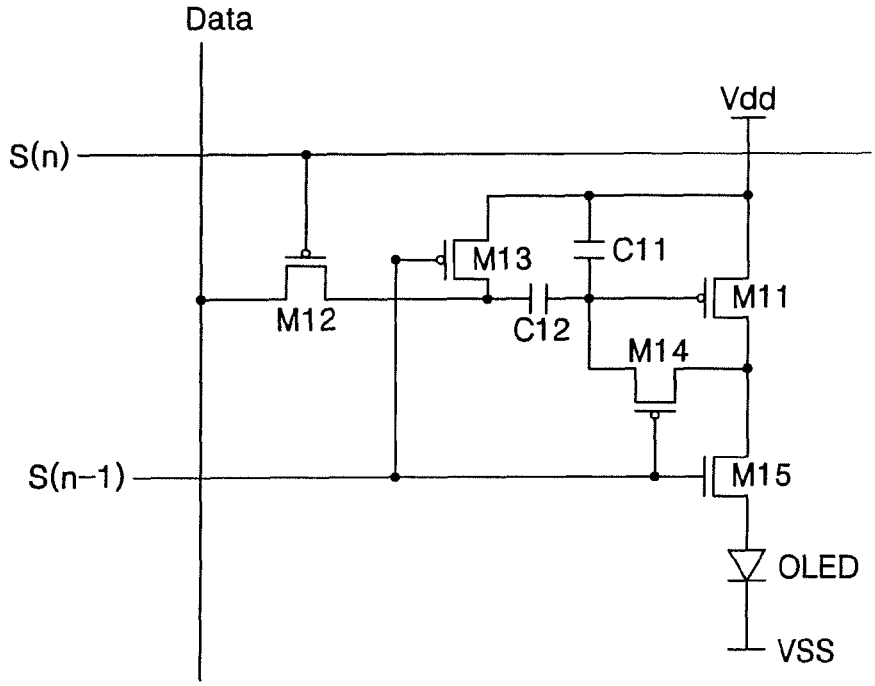
FIG. 5 is a circuit diagram illustrating a pixel circuit according to an exemplary embodiment of the present invention.

FIG. 5 is a circuit diagram of a pixel driving circuit of an organic electroluminescent display in an exemplary embodiment according to the present invention. The pixel driving circuit may also be referred to as a pixel circuit.

In FIG. 5, OLED indicates an organic EL device, M11~M15 indicate first to fifth transistors, C11 indicates a first capacitor, and C12 indicates a second capacitor.

The organic EL device OLED emits light that corresponds to the amount of applied current. For the first thin film transistor M11, a source is connected to the power supply voltage Vdd and a drain is connected to a source of the fifth thin film transistor M15. The first thin film transistor M11 supplies the organic EL device OLED with a current that corresponds to the data voltage applied to its gate through the second thin film transistor M12.

For the third thin film transistor M13, a source is connected to the power supply voltage Vdd, a gate is connected to an (n−1)th scan line S(n−1), and a drain is connected between a drain of the second thin film transistor M12 and the second capacitor C12, thus transmitting the applied power supply voltage Vdd. The third thin film transistor M13, the fourth thin film transistor M14 and the second capacitor C12 may together be referred to as a threshold voltage compensation unit.

For the fourth thin film transistor M14, a gate is connected to the (n−1)th scan line S(n−1), a drain is connected between the drain of the first thin film transistor M11 and the source of the fifth thin film transistor M15, and a source is connected between the gate of the first thin film transistor M11 and the first capacitor C11. Further, for the fifth thin film transistor M15, a gate is connected to the (n−1)th scan line S(n−1), and a drain is connected to an anode of the organic EL device OLED, thus transmitting the driving current applied from the first thin film transistor M11 to the organic EL device OLED.

As illustrated in FIG. 5, the first and second thin film transistors M11, M12 and the third and fourth thin film transistors M13, M14 are PMOS type thin film transistors, while the fifth thin film transistor M15 is an NMOS type transistor.

Further, the second capacitor C12 is connected between the gate of the first thin film transistor M11 and the drain of the second thin film transistor M12 to charge the threshold voltage of the first thin film transistor M11, and the first capacitor C11 is connected between the gate of the first thin film transistor M11 and the driving power supply Vdd to charge the data voltage applied from the second thin film transistor M12.

In addition, for the second thin film transistor M12, a gate is connected to the scan line S(n), a source is connected to the data line, and the drain is connected to the second capacitor C12.

Next, an operation of the pixel circuit of FIG. 5 will be described with reference to FIGS. 6A and 6B and FIGS. 7A and 7B.

Figure 6A:
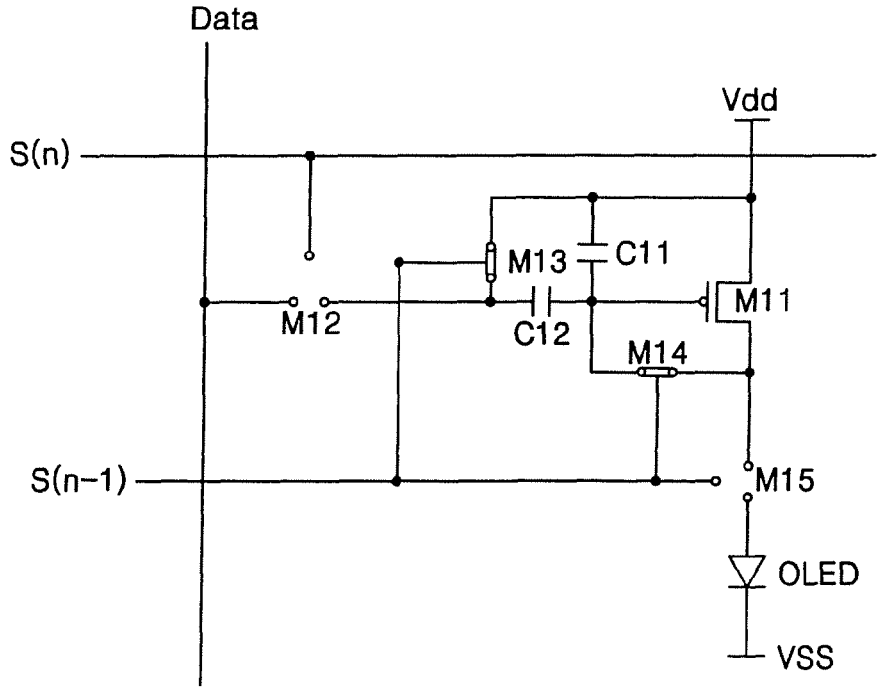
FIG. 6A is a circuit diagram illustrating an operation of the pixel circuit of FIG. 5 when an (n−1)th scan signal is applied.
Figure 6B:
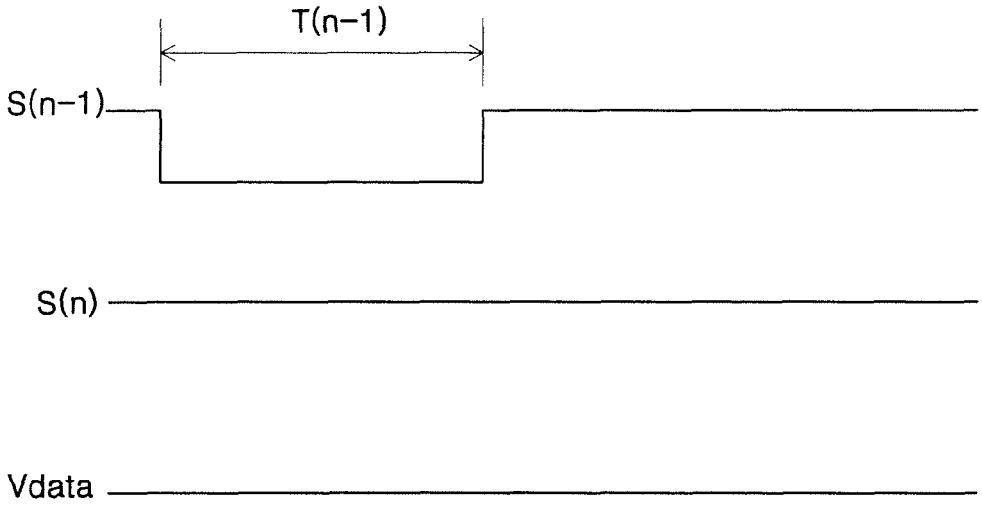
FIG. 6B is a timing diagram corresponding to FIG. 6A.

As shown in FIG. 6B, during a certain time period T(n−1), if a low signal is applied to the (n−1)th scan line S(n−1) and a high signal is applied to the nth scan line S(n), the third thin film transistor M13 and the fourth thin film transistor M14, which are PMOS type transistors, are turned on to short out, and the fifth thin film transistor M15, which is an NMOS type transistor, is turned off to remain open, whose gates are connected to the (n−1)th scan line S(n−1) as shown in FIG. 6A. Further, the second thin film transistor M12, whose gate is connected to the nth scan line S(n), is turned off to remain open.

Therefore, as the fourth thin film transistor M14 is turned on, the first thin film transistor M11 serves as a diode for the driving voltage Vdd, so that a power supply voltage outputted form the power supply voltage Vdd charges the second capacitor C12 to the voltage that corresponds to the threshold voltage of the first thin film transistor M11 through the third thin film transistor M13. Further, while the second capacitor C12 is charged, the fifth thin film transistor M15 is turned off to prevent the current from the first thin film transistor M11 from being applied to the organic EL device OLED.

Figure 7A:
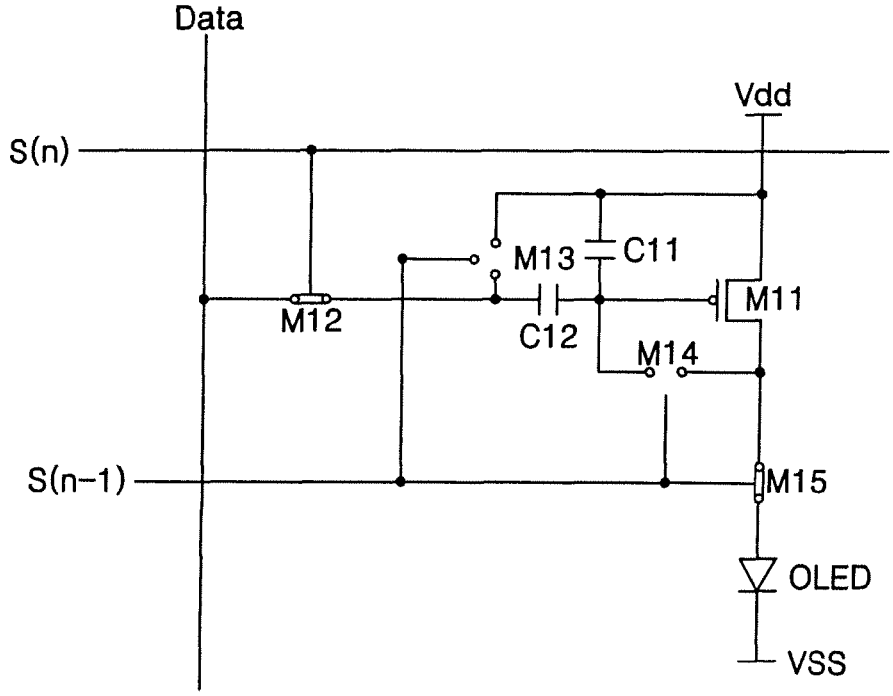
FIG. 7A is a circuit diagram illustrating an operation of the pixel circuit of FIG. 5 when an nth scan signal is applied.
Figure 7B:
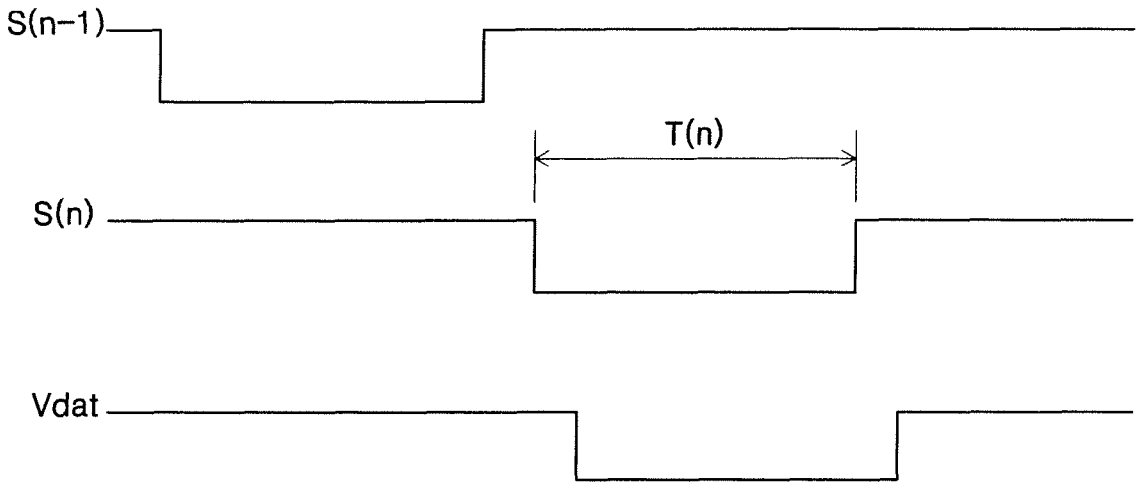
FIG. 7B is a timing diagram corresponding to FIG. 7A.

Subsequently, the (n−1)th scan line S(n−1) is transitioned from low to high, and with a certain time difference, the nth scan line S(n) is selected to output a low signal, as illustrated in FIGS. 7A and 7B.

As shown in FIG. 7A, the third and fourth thin film transistors M13 and M14, which are PMOS transistors whose gates are connected to the (n−1)th scan line S(n−1), are turned off to become open, and the fifth thin film transistor M15, which is an NMOS type transistor whose gate is connected to the (n−1)th scan line S(n−1), is turned on to remain short. Further, the PMOS type second thin film transistor M12, whose gate is connected to the nth scan line S(n), is turned on to remain short.

Further, after the signal on the scan line S(n) is changed to the low signal, the image signal from the data line is outputted, so that the data voltage Vdata is charged in the first capacitor C11 through the second thin film transistor M12.

Here, the gate voltage of the first thin film transistor M11 is the sum of the threshold voltage of the second capacitor C12 and the data voltage charged in the first capacitor C11, so that the difference of the threshold voltage Vth of the first thin film transistor M11 is compensated. That is, in the second capacitor C12, a voltage is charged as much as the difference of the threshold voltage Vth, so that the difference of the threshold voltage is not generated in each pixel.

Further, as illustrated above, as the signal on the (n−1)th scan line S(n−1) is changed from low to high, the fifth thin film transistor M15 is turned on so that the current corresponding to Equation. 1 is transmitted from the first thin film transistor M11 to the organic EL device OLED. Therefore, the organic EL device OLED emits light according to the magnitude of the applied current.

Although certain exemplary embodiments have been illustrated in the detailed description, the present invention is not limited to this, and a variety of modifications and changes can be made without departing from the spirit or scope of the invention. The scope of the present invention is indicated by the appended claims, and all changes that come within the meaning and range of equivalents thereof are intended to be embraced therein.

As illustrated above, according to the present invention, the difference of the threshold voltage of the thin film transistor for driving the organic EL device can be compensated with the previous scan line without adding an additional signal line, so that the number of wirings of the EL panel is reduced compared with the prior art, thereby reducing the number of manufacturing processes and the manufacturing cost.

What is claimed is:

1. A pixel driving circuit for an organic electroluminescent display comprising:

an organic electroluminescent device that emits light corresponding to an amount of a current being applied;

a first transistor connected to a power supply voltage for applying the current corresponding to a data voltage to the organic electroluminescent device;

a first capacitor connected between a gate electrode of the first transistor and the power supply voltage for charging the data voltage;

a threshold voltage compensation unit for charging a voltage corresponding to a threshold voltage of the first transistor in response to a selection signal from an (n−1) th scan line;

a second transistor for transmitting the data voltage from a data line in response to a selection signal from an nth scan line; and a switching unit for electrically disconnecting the first transistor from the organic electroluminescent device while the voltage corresponding to the threshold voltage is being charged in the threshold voltage compensation unit in response to a control signal, wherein the threshold voltage compensation unit includes a third transistor for configuring the first transistor as a diode in response to the selection signal from the (n−1)th scan line.

2. The pixel driving circuit according to claim 1, wherein the threshold voltage compensation unit further includes:

a second capacitor connected to the gate electrode of the first transistor for charging the voltage corresponding to the threshold voltage; and a fourth transistor for applying the power supply voltage to the second capacitor in response to the selection signal from the (n−1)th scan line.

3. The pixel driving circuit according to claim 1, wherein the first to third transistors have the same conduction properties.

4. The pixel driving circuit according to claim 1, wherein the first to third transistors are PMOS type transistors.

5. The pixel driving circuit according to claim 1, wherein the control signal is the selection signal from the (n−1)th scan line; and wherein the switching unit comprises a fourth transistor connected between the first transistor and the organic electroluminescent device, the fourth transistor being configured to respond to the control signal.

6. The pixel driving circuit according to claim 5, wherein the fourth transistor has a conduction type different from that of the first and second transistors.

7. The pixel driving circuit according to claim 5, wherein the fourth transistor is an NMOS type transistor.

8. The pixel circuit according to claim 1, wherein the voltage corresponding to the threshold voltage charged in the threshold voltage compensation unit is provided by the power supply voltage.

9. A method of driving a pixel among a plurality of pixels of an organic electroluminescent display comprising a plurality of data lines and a plurality of scan lines crossing the plurality of data lines, wherein the plurality of pixels are located in an area defined by the plurality of data lines and the plurality of scan lines, the pixel having an organic electroluminescent device and a transistor for supplying a current to the organic electroluminescent device, the method comprising:

(a) selecting a previous scan line that applies a selection signal for selecting a row of the pixel, wherein the previous scan line is an (n−1)th scan line among the plurality of scan lines;

(b) charging a threshold voltage of the transistor in response to the selection signal;

(c) after charging the threshold voltage, selecting an nth scan line among the plurality of scan lines to turn on a switching transistor and to apply a data voltage;

(d) compensating the threshold voltage by charging the applied data voltage;

(e) supplying the current corresponding to a sum of the compensated threshold voltage and the applied data voltage to the organic electroluminescent device; and (f) controlling the organic electroluminescent display such that the current is not supplied while the threshold voltage is applied in response to the selection signal of the previous scan line to prevent a current difference between the pixels, wherein the threshold voltage is charged by applying a power supply voltage.

10. A pixel driving circuit for an organic electroluminescent display comprising:

an organic electroluminescent device that emits light corresponding to an amount of a current being applied;

a first capacitor for charging a data voltage in response to a first selection signal applied on an nth scan line;

a first transistor for applying the current to the organic electroluminescent device;

a second capacitor for charging a voltage corresponding to a threshold voltage of the first transistor in response to a second selection signal applied on an (n−1)th scan line; and a second transistor for configuring the first transistor as a diode in response to the second selection signal, wherein the charged data voltage and the charged voltage corresponding to the threshold voltage are applied to a gate of the first transistor to generate the current applied to the organic electroluminescent device.

11. The pixel driving circuit of claim 10, wherein the nth scan line is a current scan line and the (n−1)th scan line is a previous scan line.

12. The pixel driving circuit of claim 10, further comprising a third transistor for transmitting the data voltage from a data line in response to the first selection signal, such that the data voltage can be charged in the first capacitor.

13. The pixel driving circuit of claim 10, further comprising a third transistor for applying a power supply voltage to the second capacitor in response to the second selection signal, such that the voltage corresponding to the threshold voltage can be charged in the second capacitor.

* * * * *